United States Patent [19]

Kupersmit

[11] Patent Number: 4,821,879

[45] Date of Patent: Apr. 18, 1989

[54] CRADLE TYPE SHIPPING CONTAINER

[76] Inventor: Julius B. Kupersmit, 299 W. 12th St., New York, N.Y. 10014

[21] Appl. No.: 163,247

[22] Filed: Feb. 29, 1988

[51] Int. Cl.[4] ..... B65D 19/00

[52] U.S. Cl. ..... 206/386

[58] Field of Search ..... 206/298, 386

[56] References Cited

U.S. PATENT DOCUMENTS 4,512,477 4/1985 Densen ..... 206/298

4,576,280 3/1986 Dove et al. ..... 206/298

*Primary Examiner*—Joseph Man-fu Moy

*Attorney, Agent, or Firm*—Charles E. Temko

[57] ABSTRACT

A reuseable shipping container for manufactured subcomponents and parts suitable for use on a manufacturing assembly line. The parts are not individually wrapped, but are suspended upon flexible cradle-like supports, the ends of which are carried upon elongated bars carried by the container for relative movement in a direction perpendicular to the axis of the bars. One vertical side of the container is removable to provide access to the interior thereof. The container is loaded by engaging the parts on the cradle-like supports in a vertical stack, carried by a bar, following which the bar is moved in a direction away from the opening. A second bar is engaged with the container, and a second vertical stack is formed. This process is continued until the container is substantially filled. Unloading takes place in reverse order. When emptied, the container may be collapsed for return to a point of reloading.

5 Claims, 3 Drawing Sheets

CRADLE TYPE SHIPPING CONTAINER

BACKGROUND OF THE INVENTION

This invention relates generally to the field of collapsible, reuseable shipping containers, and more particularly to an improved form thereof, suitable for transporting manufactured sub-components to a point of assembly where the container serves as a storage bin adjacent an assembly line. While the invention has application in a wide range of assembly procedures, it has particular utility in the assembly of automotive vehicles and the like.

In the assembly of relatively large components to form a completed product, components are normally individually wrapped or packaged, following which they are placed in a larger container for shipment to a point of assembly. Upon arrival, they are individually removed from the larger container, unwrapped and positioned at a point along the assembly line for subsequent integration. To facilitate such positioning, the components are sometimes positioned in trays which are stacked within the larger container, and the trays are removed from the container in serial fashion.

The problems accompanying such procedure are readily apparent. In some cases, the components must be individually unwrapped leaving the wrappers to be discared. In the case of the above-mentioned stack trays, the trays must be stored after removal of the components therefrom to occupy valuable space adjacent the assembly line. If the trays are reusable, they also occupy sufficient space within the larger container to prevent the container from being collapsed for return shipment. Where the components are relatively heavy, it is difficult to remove the supporting trays from the container since they must be lifted from the side edges thereof requiring access to the container on all sides thereof for manual engagement.

SUMMARY OF THE INVENTION

Briefly stated, the invention contemplates the provision of an improved shipping container of the class described in which the above-mentioned difficulties have been substantially eliminated.

To this end, the disclosed embodiments comprise a collapsible, reusable, generally rectangular shipping container which is preferably supported upon an interconnected rigid pallet of known type. One of the vertical side walls of the container defines an opening therein providing access to the interior thereof after removal of an upper lid element. The upper horizontal edges of a pair of oppositely disposed side walls on either side of the opening are reenforced, and are provided with channel-forming members which support a plurality of elongated supporting bars therebetween for movement laterally of the access of the bars toward and away from the opening. The bars, in turn, support along the length thereof, plural strap-like cradles, each including plural segments which jointly support elongated components in vertically stacked relation. The segments are individually opened to allow release of individual parts for removal as required starting from the lowermost part in a given stack. When all of the parts in a single stack have been moved, the corresponding bar is also removed, and the immediately adjacent bar is moved in a direction toward the access opening where the process is repeated until the parts carried by the successive stacks have been removed. With the removal of the last stack the bars and cradles may be stored upon the bottom wall of the container, following which the container is then collapsed along fold lines above and parallel to the bottom wall to allow return shipment of the container to a shipment of the container to a point of origin while occupying substantially reduced volume.

In a second embodiment suitable for use in shipping relatively small non-elongated parts, the cradle is substituted by a sheet-like carrier containing pockets on an exposed surface thereof, each pocket containing an individual part. The carrier is supported upon an individual bar as described above. After removal of the parts, the pockets are collapsed to bring the carrier to generally planar condition, for storage upon the bottom wall of the container, following which the container is collapsed as described above.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
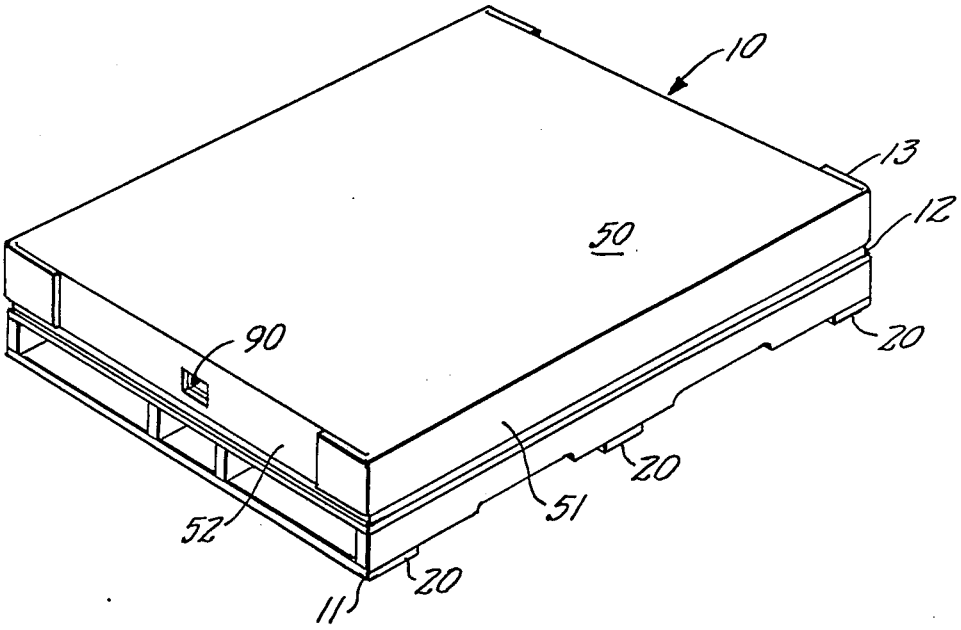
FIG. 1 is a view in perspective of a first embodiment of the invention in fully collapsed condition with an upper lid in position.
Figure 3:
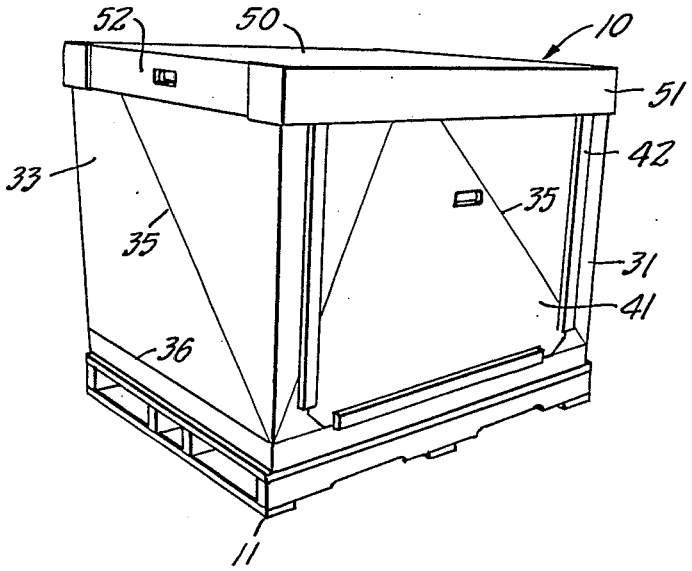
FIG. 3 is a view in perspective thereof showing the device in loaded condition ready for shipping.

In accordance with the first embodiment of the invention, the device, generally indicated by reference character 10, comprises broadly: a pallet element 11, a collapsible box element 12, a lid element 13, and a plurality of load-supporting elements 14.

The pallet element 11 is of known type, preferably formed from wood or other rigid materials, and include a plurality of lower skid members 20, spaced vertical supporting members 21 and an upper wall 22, the members 21 forming openings 23 for engagement by a fork lift (now shown).

The box-element 12 is preferably of heavy-duty corrugated paper construction, and includes a lower wall 30, a front wall 31, a rear wall 32, and a pair of opposed side walls 33 and 34. The walls are provided with angularly disposed fold lines 35 to permit the container to be collapsed above a plane defined by horizontal fold lines 36, so as to provide space for storage of the elements 14 when not in use.

The front wall 31 is provided with a rectangular opening 37 bounded by a lower edge 38 and side edges 39 and 40. This opening is closed by a laminated front door 41 which engages the edges 38–40 by means of extruded synthetic resinous channel members 42 having a "H" cross section. To provide sufficient rigidity, the walls 32–34 are reenforced by an insert member 43 including corresponding side walls 44 and 45, and rear wall 46. Reenforcement is provided behind the front wall 31 by synthetic resinous or metallic edge-supporting extrusions 47 on the free edges of the insert member, and extrusions 48 on the vertical free edges of the laminated door 41.

The lid element 13 is generally conventional, and can be formed from a single piece of corrugated material. It includes an upper wall 50, a pair of longitudinal side walls, one of which is indicated by reference character 51, and a pair of transverse side walls, one of which is indicated by reference character 52.

The support elements 14 are supported upon a pair of channel forming members 60 which engage opposed upper edges of the insert member 43, and define a pair of parallel upwardly facing channels 61 which engage the free ends of transversely extending support bars 62, so as to be disposed inwardly of the upward edges 63 of the side walls 33–34. The bars 62 are provided with corresponding channel engaging members 64 at the free ends 65 thereof, the members 64 being preferably coated with nylon or other lubricant to facilitate movement within the channels 61.

Figure 6:
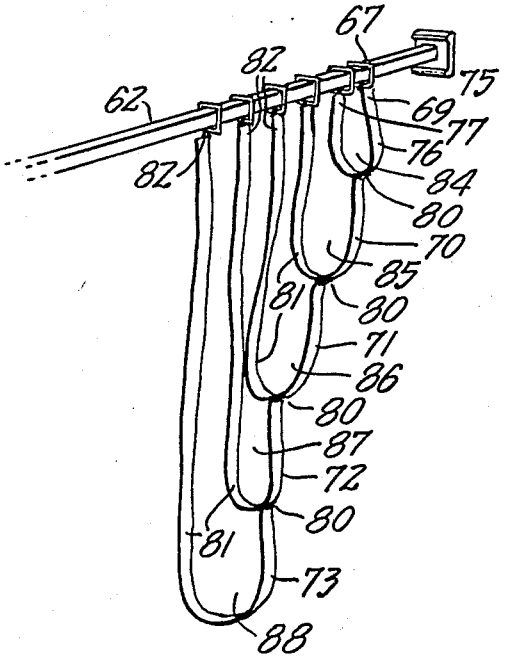
FIG. 6 is a view in perspective showing the details of an individual web cradle.
Figure 7:
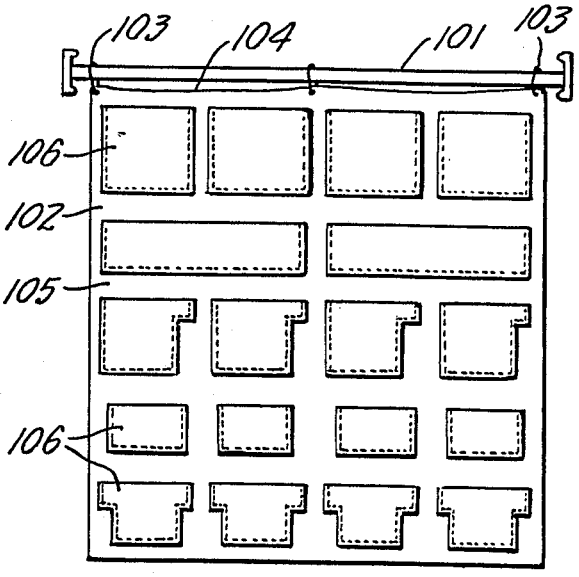
FIG. 7 is a view in elevation showing a second embodiment of the invention.

Medially of the free ends 65, the bars 62 are provided with multiple cradle elements 67 best seen in FIG. 6 in the drawings. Each cradle member includes a primary strap member 69 which directly or indirectly supports strap members 70, 71, 72 and 73, each of which, in engaged condition, defines an enclosure engaging a subcomponent part or other object 74.

The strap member 69, which is preferably composed of woven webbing, includes a first end loop which surrounds the bar, a medial portion 76, and a second end 77 having a hook which engages an opening (not shown) in the bar 62. Each succeeding strap member 70–73 includes a first end 80 which is permanently interconnected to a medial portion of a preceding strap, its own medial portion 81, and a second hooked end 82 which also engages its own opening (now shown) in the bar 62. Thus, when fully interconnected, there are a series of loop openings 84, 85, 86, 87, and 88, each of which surrounds a portion of a part 74.

At this point in the disclosure, the discussion of the loading and the unloading of the embodiment is apposite. The embodiment may be erected from a collapsed condition in a manner well-known in the art to the condition shown in FIG. 2 in the drawings, following which the insert member 43 is positioned within the open confines of the box prior to the commencement of loading. The channel members 60 are then positioned, and a first bar 62 is then positioned thereon adjacent the opening 37.

The loaded parts 74, will normally be of generally elongated configuration, as exemplified by an axle, or a wiring harness. Each such part will normally be supported adjacent the ends thereof and at the middle. Loading commences by first engaging the strap members 69 at the upper end of a stack to be formed, and each succeeding part is then positioned therebeneath to be engaged by one of the strap members 70–73 in a similar manner.

Figure 2:
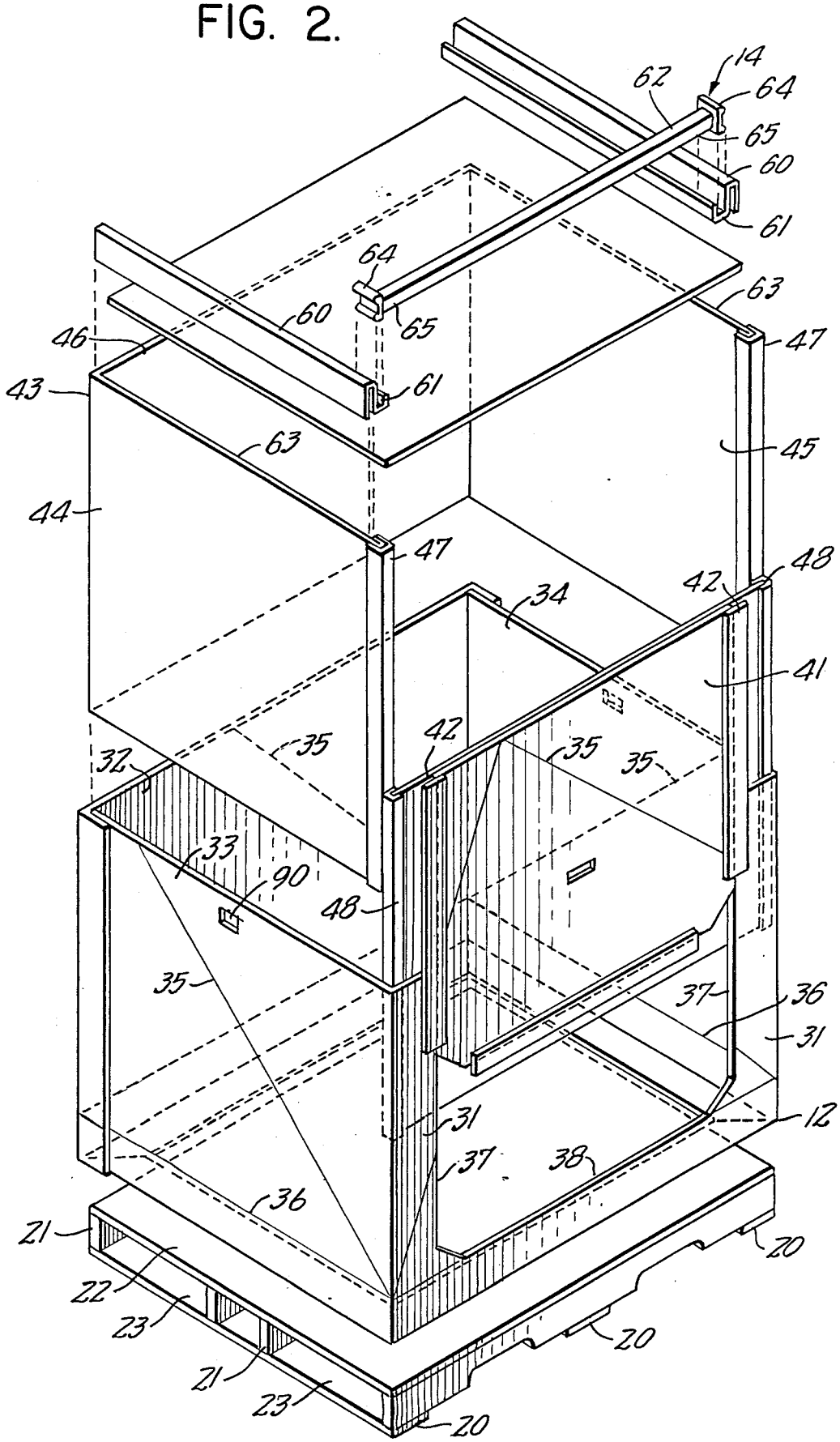
FIG. 2 is an exploded view in perspective thereof showing the same in fully erected condition prior to loading.
Figure 4:
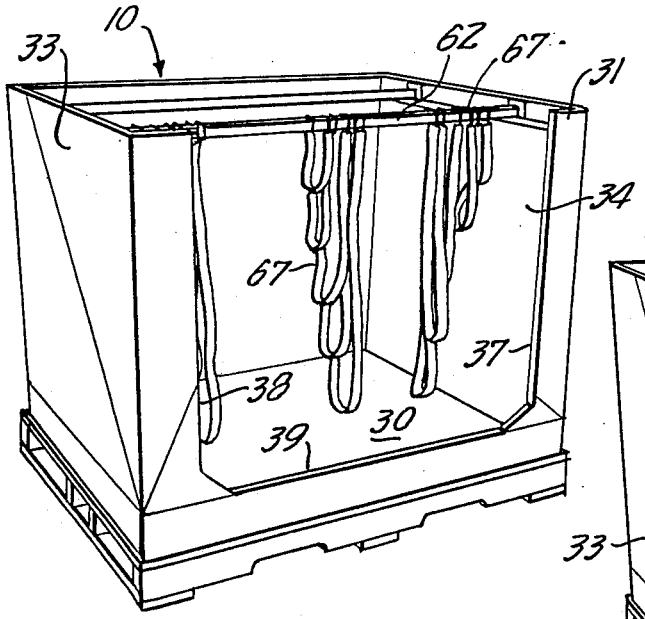
FIG. 4 is a view in perspective thereof showing the positioning of load supporting elements including web cradles prior to loading.
Figure 5:
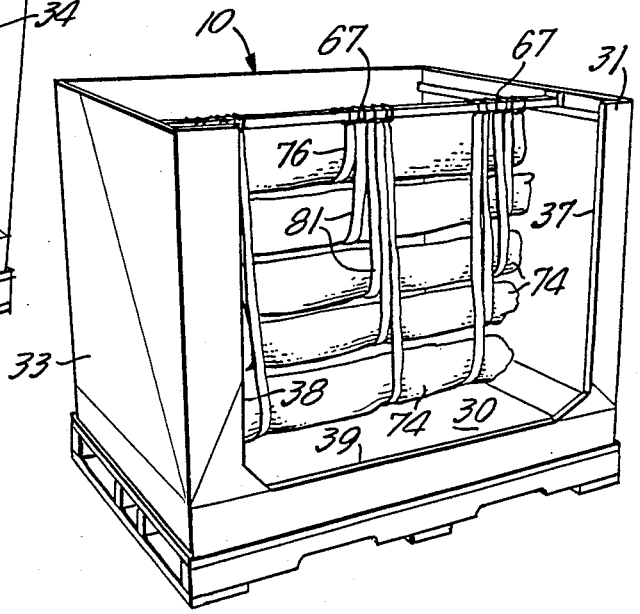
FIG. 5 is a view in perspective showing a fully loaded container.

With the complete loading of a stack of parts 74, the entire stack, supported by the bar 62 is then moved rearwardly to lie adjacent the rear wall 32, a second bar 62 is positioned in similar fashion, and another stack is formed in a similar manner. This process is continued until a sufficient number of stacks has been formed to completely fill the interior of the box element 12. At this point, the front door 41 is engaged within the opening 37, as shown in FIG. 2, and slid downwardly, which movement is facilitated by the sliding engagement of the extrusions 47 and 48. Once fully seated, the door 41 provides a reenforcement during shipment equivalent to that provided by each of the walls of the insert member 43. The lid element 13 is then positioned, being locked in position by means engaging the openings 90 in the lid element 13 and 91 in the side walls 33 and 34, using a known locking means (not shown).

Upon arrival at the assembly plant, the device may be positioned adjacent an assembly station, the lid element removed, and the front door 41 disengaged. At this point, unloading takes place commencing with the lowermost part supported by strap members 73 in the stack located immediately adjacent the opening 37. The strap members 70–73 are then disengaged in reverse serial fashion, whereby each such disengagement makes available another part or movement to the point of assembly. Strap member 69, being opened in a similar fashion completely empties the stack, following which the corresponding rod 62 is lifted from engagement with the channels 61, and the next stack is then moved forwardly adjacent the opening 37 where the process is repeated. Upon retrieval of the last part in the final stack, the bars 62 may be positioned upon the lower wall 30, and the box element collapsed with the lid element 13 being repositioned as shown in FIG. 1 for reshipment to a point of origin.

Turning now to the second embodiment of the invention, this differs from the first embodiment in the substitution of a different form of cradle for use with relatively non-elongated parts of relatively smaller size. To this end, the supporting bars 101 are provided with the sheet-like individual carriers 102 which may be formed of canvas webbing or the like, each carrier having a rod-engaging loop 103 at an upper edge 104 thereof, and providing a forwardly facing surface 105 having plural pockets 106 of shapes which correspond to the objects to be supported thereby. Loading and unloading of the embodiment is generally similar to that employed in the case of the first embodiment, except that it is not necessary to fasten or unfasten the web straps of the first embodiment. As each carrier 102 is emptied, it and the corresponding bar are removed. The flatening of the pockets reduces the carriers 102 to generally planar configuration, and they may be stacked upon each other in the space beneath the horizontal fold lines 36 prior to the collapse of the box element.

Normally, no individual wrapping or packaging will be required in the case of component parts which are either sufficiently rigid or flexible to prevent damage. When the box element is fully loaded, the suspended parts will be capable of little, if any, relative motion, and thus will be fully protected against damage during shipment. In specialized situations, it may be desirable to individually wrap the parts to provide additional production. In the case of the second embodiment, the pockets 106 may be provided with foam lining to effect the same purpose.

I wish it to be understood that I do not consider the invention limited to the precise details of structure shown and set forth in this specification, for obvious modifications will occur to those skilled in the art to which the invention pertains.

I claim:

1. An improved shipping container comprising: a generally rectangular box element including a bottom wall, a pair of oppositely disposed vertical side walls, a vertical rear wall and a vertical front wall defining an opening therein, said side walls having upper horizontal edges, plural channel-forming members engaged upon said upper edges of said side walls, and at least one load-supporting element including an elongated rigid bar having first and second ends engaging said channel forming members for lateral sliding movement of said bar upon said channel-forming members; said bar having plural load-supporting means in pendant relation thereon, each of said means detachably engaging a plurality of supported objects in generally vertically stacked relation for serial removal, as said objects are moved adjacent said opening.

2. A shipping container in accordance with claim 1, further characterized in said load-supporting means being in the form of a multiple strap cradle, each strap of which engages an individual supported object, one of said straps having first and second ends engaging said bar, the remainder of said straps having a first end secured to said bar, and second ends selectively engageable with a medial portion of an adjacent strap.

3. A shipping container in accordance with claim 1, further characterized in said load-supporting means being in the form of a sheet-like carrier having multiple article carrying means on a planar surface thereof.

4. A shipping container in accordance with claim 3, further characterized in said carrying means being in the form of expandable pockets.

5. A shipping container in accordance with claim 1, further characterized in said box element being foldable to collapsed condition to provide space for storage of said loadsupporting elements when not in use.

* * * * *